United States Patent [19]

Woedl et al.

[11] Patent Number: 4,829,639

[45] Date of Patent: May 16, 1989

[54] CASKET

[75] Inventors: Stephen D. Woedl, Oxford; Gary L. Cox, College Corner, both of Ohio

[73] Assignee: Oxford Design Inc., Liberty, Ind.

[21] Appl. No.: 108,731

[22] Filed: Oct. 14, 1987

[51] Int. Cl.[4] ..... A61G 17/04

[52] U.S. Cl. ..... 27/6; 27/2

[58] Field of Search ..... 27/2, 3, 5, 6, 4, 7, 27/8, 10

[56] References Cited

U.S. PATENT DOCUMENTS

| | | | |
|---|---|---|---|
| 86,396 | 2/1869 | Hathaway | 27/6 |
| 213,762 | 4/1879 | Leach et al. | 27/3 |
| 235,376 | 12/1880 | Orr | 27/2 |
| 253,545 | 2/1882 | McLean | 27/3 |
| 304,113 | 8/1884 | Locher | 27/4 |
| 347,172 | 8/1886 | Gould et al. | 27/6 |
| 353,772 | 12/1886 | Baker | 27/6 |
| 756,297 | 4/1904 | Tabor et al. | 27/2 |
| 1,128,865 | 2/1915 | Freeman | 27/35 |
| 1,234,180 | 7/1917 | Kersten | 27/3 |
| 1,348,579 | 8/1920 | Post et al. | 27/3 |
| 1,373,730 | 4/1921 | Hollins | 27/2 |
| 1,431,827 | 10/1922 | Manning | 27/8 |
| 1,903,197 | 3/1933 | Scott | 27/3 |
| 1,903,198 | 3/1933 | Scott | 27/3 |
| 2,431,183 | 11/1947 | Mansfield | 27/3 |
| 2,437,141 | 3/1948 | Wallace | 27/6 |
| 2,945,281 | 7/1960 | Wilkirson | 27/17 |

FOREIGN PATENT DOCUMENTS

| | | | |
|---|---|---|---|
| 84859 | 4/1957 | Netherlands | 27/2 |

*Primary Examiner*—Robert A. Hafer
*Assistant Examiner*—Sam Rimell
*Attorney, Agent, or Firm*—John T. Synnestvedt; Kenneth P. Synnestvedt

[57] ABSTRACT

A casket having a shell formed of sheet material and having a frame surrounding a lower portion of the shell, the frame having casket-handling components and being separably interconnected with the shell.

8 Claims, 6 Drawing Sheets

CASKET

BACKGROUND AND STATEMENT OF OBJECTS

This invention relates to a novel form of casket, the casket comprising a shell formed of sheet material and having a frame adapted to surround the shell and being separably interconnected with the shell, the frame having casket-handling components.

It is an object of the present invention to provide a construction of the kind referred to above and further in which the casket has an appropriate and attractive appearance, notwithstanding fabrication of the casket shell of relatively inexpensive sheet material.

The shell and the frame have interengageable load-transmitting abutments providing for manually carrying the casket by manually engaging handling components mounted on the frame.

In a preferred embodiment of the invention, the shell of the casket is formed of sheet metal, and the various parts or portions of the shell, referred to in the following description, are preferably integrated into a single structure. The shell preferably has an upper portion with an upwardly presented opening and also has a downwardly closed bottom portion, the upper and bottom portions of the shell being interconnected by a generally horizontal junction strip. According to this preferred embodiment, the frame having the casket-handling components surrounds the bottom portion of the shell, with the upper edge of the frame in abutting relation to the junction strip interconnecting the upper and lower portions of the shell.

In this manner, the weight of the casket can readily be carried by the handling components mounted on the frame, and the necessity for attachment of handling components directly to the shell of the casket is eliminated.

In a preferred embodiment, the junction strip between the upper and lower portions of the shell preferably extends not only along the longitudinal edges of the casket but also along the end edges thereof, and the frame has casket-handling components similarly extended not only along the longitudinal edges of the casket but also along the end edges thereof.

The foregoing preferred construction of the casket has various advantages including the fact that the handling or carrying load is distributed along both the sides of the casket as well as along the ends thereof. This load distribution around the perimeter of the casket makes possible the fabrication of the casket shell from sheet material of various forms and especially of sheet metal which is much thinner than is practical to employ in the absence of the arrangement referred to of the shell and a surrounding load-carrying framing.

It is another object of the invention to provide not only for effective load-carrying capability of the framing surrounding the shell, but also to provide a system in which the framing is readily separable from the shell. When arranged to provide for this ready separation of the framing from the shell, it becomes practical to provide for repeated reuse of the framing, by separation of the framing of the shell before the act of interment.

When employing this ready separability of the carrying framing from the shell, it is also an object of the invention to utilize a framing, desirably formed of fine quality wood, which framing may be highly decorative and attractive, which becomes practical and feasible by virtue of the reusability of the framing with sequential funeral services.

The shape of the shell may be varied according to different tastes and according to the character of the sheet materials being employed to form the shell, but in the case of a sheet metal shell, one embodiment of the invention contemplates the provision of a shell of which both the lower and the upper portions thereof are upwardly flared, with the generally horizontal junction strip above referred to disposed between the flared wall of the lower portion and the flared wall of the upper portion. This makes possible production of the shell by so-called deep drawing of thin sheet metal material.

The capability of forming the shell by deep drawing of thin sheet metal material is of substantial advantage because this eliminates the necessity for corner welding of sheet metal components.

It is contemplated to employ a lid for the casket or shell of conventional configuration or construction in any of the embodiments referred to.

DETAILED DESCRIPTION OF THE DRAWINGS

Figure 1:
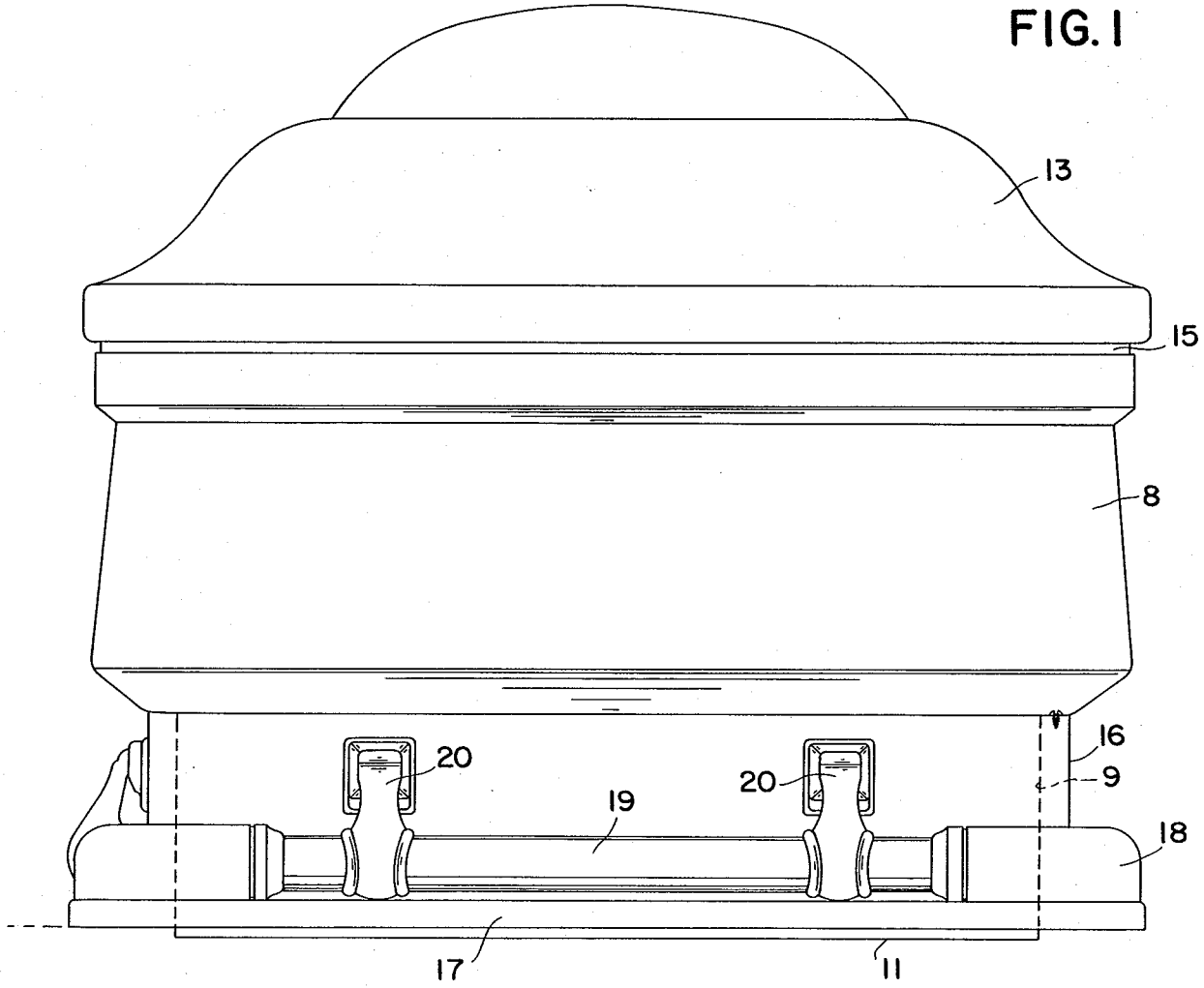
FIG. 1 is an end view of one embodiment of a casket according to the invention including the shell, the frame with the handling components, and the lid.

In connection with the first embodiment which is illustrated in FIGS. 1 to 5 inclusive, it is first noted that the shell of the casket is formed of upper and lower interconnected portions generally identified by the reference numerals 8 and 9. The upper portion 8 is upwardly open in the central region and has a marginal flange 10 at the top with which the lid mounting hinges are adapted to be associated.

The lower portion 9 of the shell is connected with the lower edge of the upper portion and has a closed bottom wall, as indicated at 11.

The adjoining edges of the upper and lower portions of the casket shell are interconnected by a generally horizontal junction strip 12, and it is contemplated that the entire shell be formed of sheet material, including the interconnection junction strip between the upper and lower portions.

Various sheet materials may be used in the embodiment of FIGS. 1 to 5, including sheet metal, such as steel or aluminum, or other sheet materials, such as high-strength or fiber-reinforced plastic materials.

A lid 13 of conventional type may be associated with the upwardly open central region of the upper portion 8 of the casket shell, and the lid may be connected by means of a hinge device of known type. The hinge device forms no part of the present invention. Therefore, the hinge device is indicated generally in FIG. 5 at 14. A gasket or seal 15 is desirably inserted between the flange 10 of the upper portion of the casket and the lower portion of the casket lid.

The invention also contemplates the employment of a centrally open frame surrounding the bottom portion 8 of the casket shell, this frame being indicated in various figures as having frame strip components 16—17 extended along the longitudinal sides of the shell and also similar components 16—17 extended along the ends of the lower portion of the shell.

At the corners of the frame, there are also provided enlarged corner elements 18 which serve to mount the ends of casket-handling components of known type comprising rods or handles 19 which extend along both the side and the end edges of the lower portion of the frame 16. These handling rods may also be interconnected with the upper portion of the framing 16 by means of connecting joints indicated in Figures 1 and 2 at 20.

The arrangement of the framing with the handles 19, as above described, provides for convenient manual access to the casket-carrying devices extended around the perimeter of the lower portion of the casket.

In accordance with the invention, the upper portion 16 of the frame 16—17 has an upper edge which abuts against the interconnecting horizontal junction strip 12 along the line of connection of the lower edge of the upper portion of the shell with the upper edge of the lower portion of the shell. This is clearly illustrated in FIG. 2, which further shows one form of means for attachment of the shell and the framing to each other. Thus, in FIG. 2, one of a series of screws 21 is illustrated, this screw being extended through an aperture provided in the junction strip 12 and extending down into the upper edge of the wood of the framing shown at 16 in FIG. 2. In this embodiment (FIGS. 1 to 5 inclusive), it is contemplated that such screws be provided at intervals along both the side edges and the end edges of the framing. In this way, a simple means for assembly and disassembly of the casket shell and frame is provided.

It will be noted in connection with this separable fastening means that the primary load of the casket when the casket is being carried by the handles 19 is not transmitted through the screws 21. The primary load of the casket in the configuration illustrated and described is transmitted from the casket shell to the junction strip 12 at the sides and ends of the casket and from the junction strip directly to the corresponding upper surfaces of the elements 16 of the framing 16—17 with which the carrying handles 19 are connected.

Figure 2:
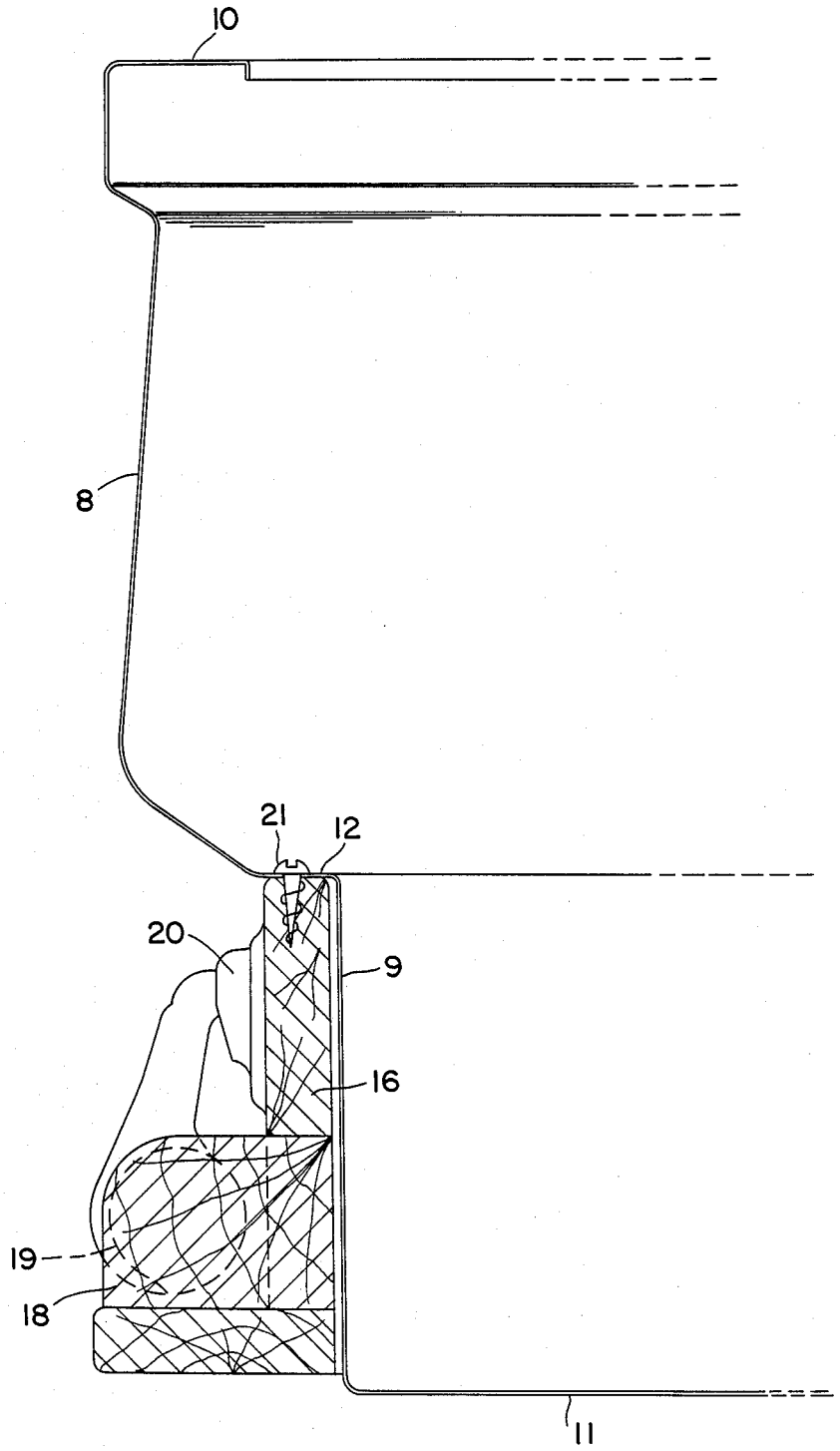
FIG. 2 is a diagrammatic sectional view through a portion of a side wall of a casket according to the embodiment of FIG. 1 and illustrating also the cross sectional shape of the framing.
Figure 3:
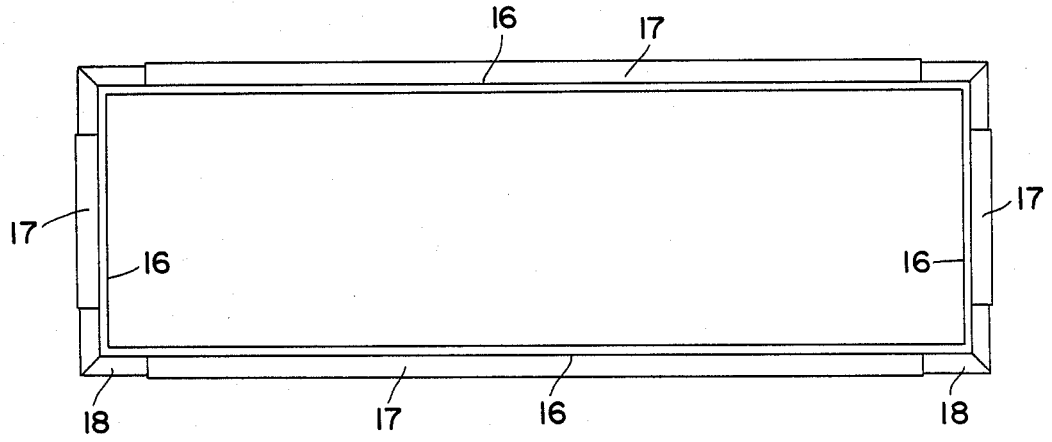
FIG. 3 is a plan view of the framing of the first embodiment but without illustrating the handling components.
Figure 4:
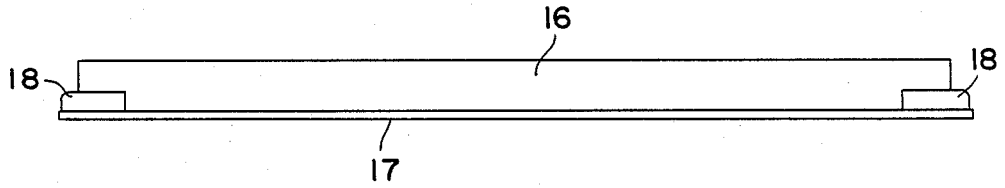
FIG. 4 is an edge elevational view of the framing shown in FIG. 3.
Figure 5:
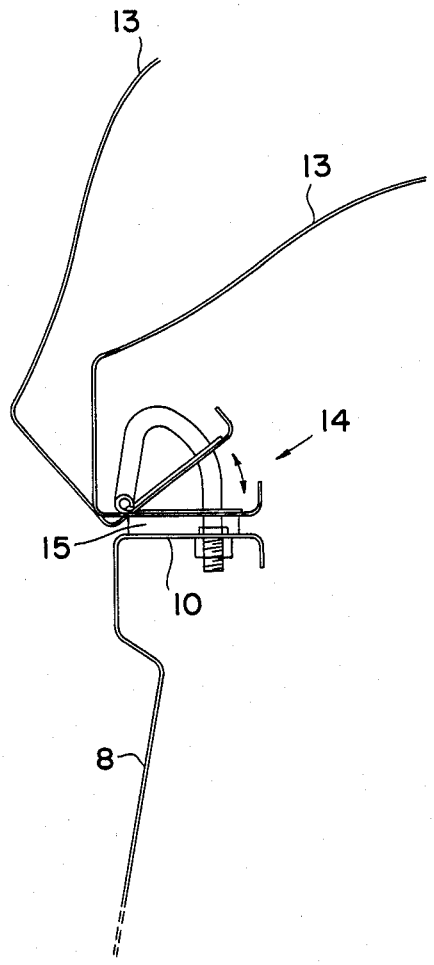
FIG. 5 is a diagrammatic view of the upper edge portion of the embodiment of the shell shown in FIGS. 1 to 4 but illustrating the application of a known type of hinge for connecting one edge of the lid of the casket to the shell.
Figure 6:
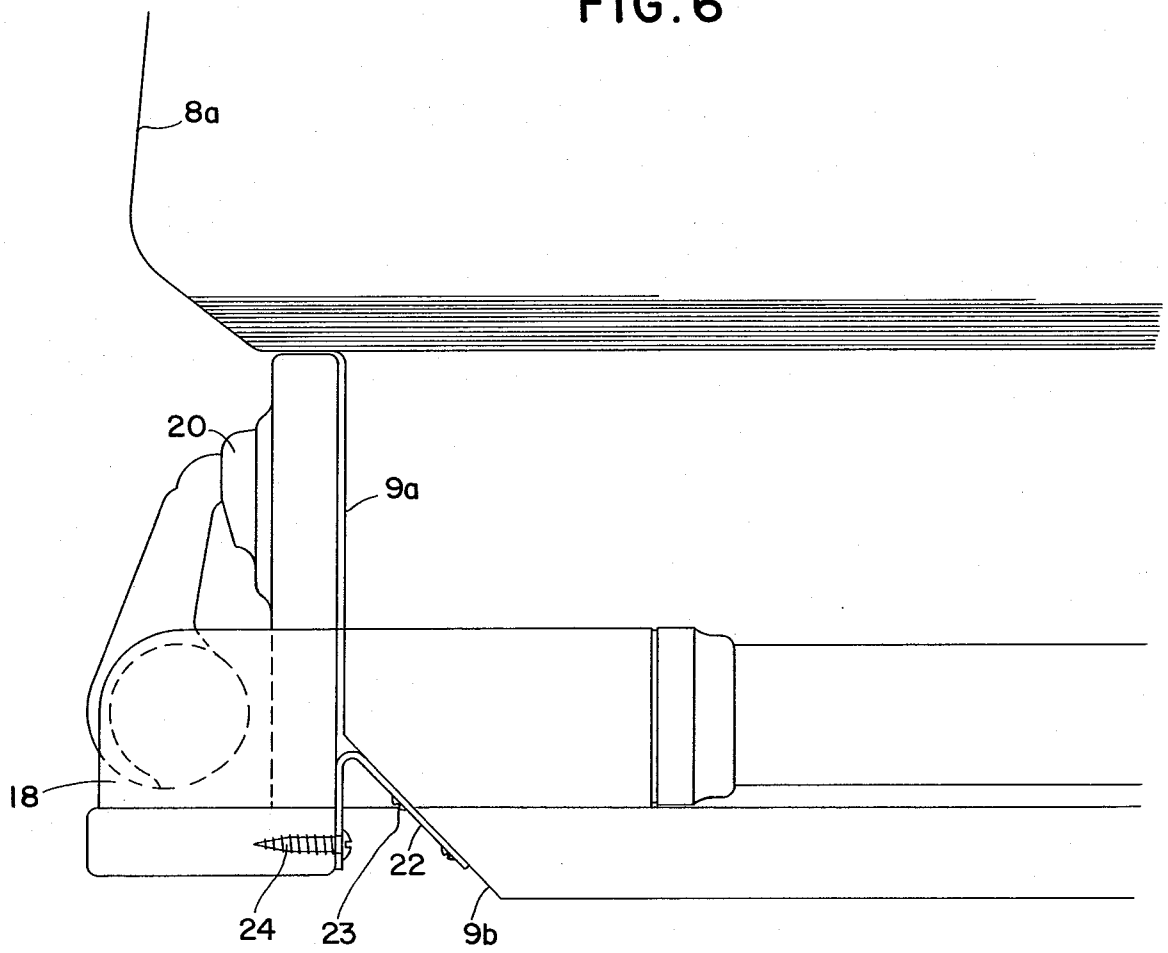
FIG. 6 is a schematic view similar to FIG. 2 but illustrating an embodiment in which a modified form of disconnectable means is provided for interconnecting the shell and the frame.

The embodiment of FIG. 6, which represents a view similar to FIG. 2, discloses a modified form of the casket shell and a modified form of the separable fastening means for interconnecting the shell and the framing. Thus, in FIG. 6, the upper portion **8*a* of the casket shell is associated with a lower portion 9*a* of generally similar configuration to that shown in FIGS. 1 to 5. However, in FIG. 6, the lower edge of the lower portion 9*a* is provided with an inclined bevelled edge, indicated at 9*b*, it being contemplated that this be provided not only along the side edges of the casket shell, but also along the end edges thereof. This provides a downwardly open V-shaped channel running around the perimeter of the bottom of the lower portion of the casket shell. This space may be used to accommodate disconnectable fastening means for interconnecting the shell and the framing. In this embodiment, such fastening means may comprise angle strips 22 positioned at spaced intervals along the sides and ends of the casket. Where the shell is formed of sheet metal, such strips are desirably spot welded to the outer side of the casket shell, as indicated at 23. The strips may also be fastened by means of screws 24 extended through apertures in the strips 22 and secured in an adjoining portion of the surrounding wood framing 16**.

Where sheet material other than metal is employed for the casket shell in the arrangement of FIG. 6, some other form of fastening means may be employed for connecting the separable strips 22 with the casket shell.

Figure 7:
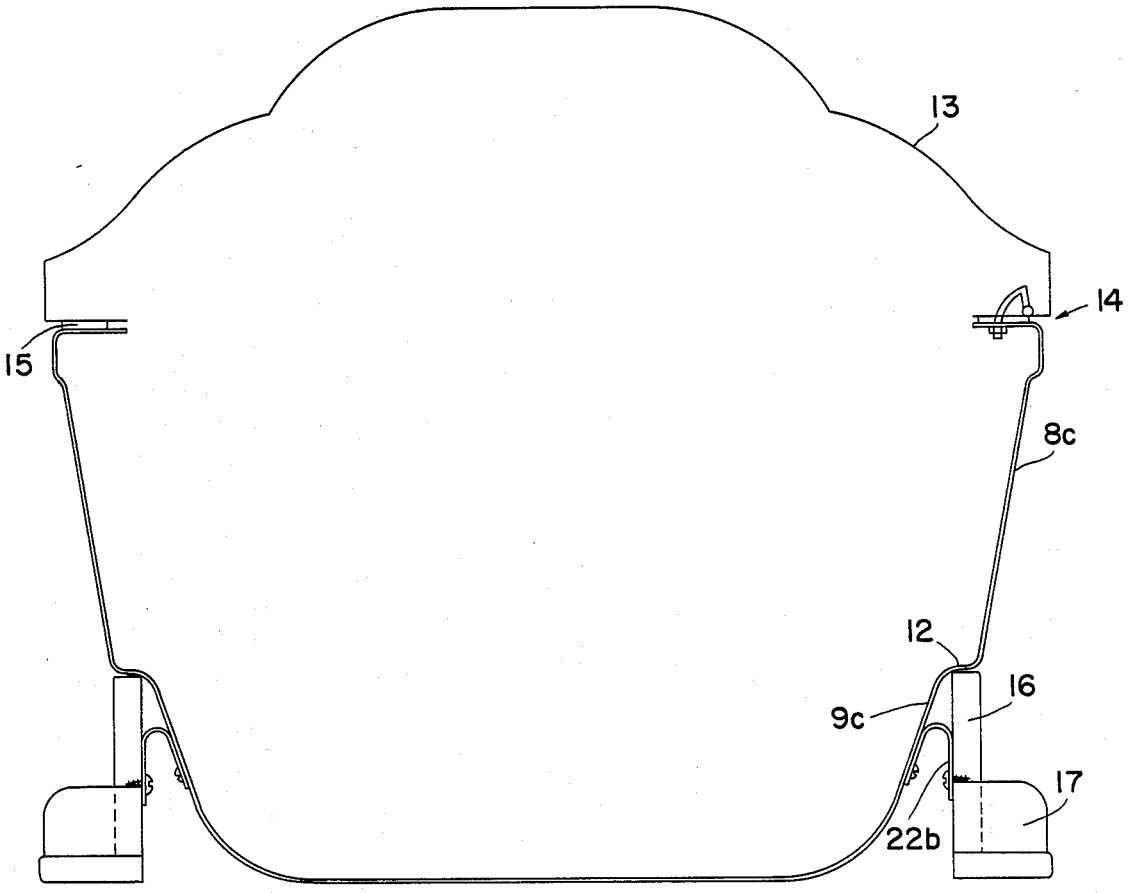
FIG. 7 is a diagrammatic view of the overall cross-sectional shape of an alternative embodiment of a shell configuration particularly adapted for formation from thin sheet metal material, this embodiment including lower and upper portions of the shell both having upwardly flared side walls.

In the embodiment of FIG. 7, both the upper and lower portions **8*c* and 9*c* of the casket shell are upwardly flared, as indicated in this view. It is contemplated that such upward flaring be employed not only at the side edges of the casket shell, as is shown in FIG. 7, but also at the end edges thereof. This configuration of the shell is especially effective when employing relatively thin metal sheet. With the upwardly flared top and bottom portions 8c and 9c, as shown in FIG. 7 (interconnected by the junction strip 12), and the concurrent use of thin metal, the shell may be formed by a deep drawing operation, thereby greatly simplifying the shell construction. Formation of the shell by a deep drawing operation is more readily effected when the upper and lower walls 8*c* and 9*c* are outwardly flared or tapered (as in FIG. 7) instead of perpendicular to the bottom wall as with the wall 9** in the other embodiments. It will be understood that appropriate flanges for cooperation with gaskets and lids may be provided by separate local bending operations after the deep drawing operation.

It is also contemplated in the embodiment of FIG. 7 to employ interconnecting strips **22*b* similar to those described in connection with FIG. 6, so that the framing 16—17** and the shell of the casket may readily be connected and disconnected.

The foregoing provision for connection and disconnection of the framing and of the shell of the casket is of special significance in relation to a system contemplating use and reuse of the framing with a sequence of shells. It is contemplated that the framing be formed of a special construction including decorative parts, such as the casket-handling components. Fine quality wood may also be incorporated in the framing, and in this manner, an attractive and decorative overall appearance can be provided at reduced cost because of the capability of reusing the framing with a sequence of casket shells.

We claim:

1. A casket comprising a generally rectangular shell formed of sheet metal, the shell having an upper portion with an upwardly presented opening, the shell also having a downwardly closed bottom portion of reduced dimensions both lengthwise and from side-to-side as compared with the upper portion, the upper and bottom portions of the shell being interconnected by a generally horizontal junction strip extended along both the sides and the ends of the shell, a rectangular frame formed of wood and having interconnected side and end portions forming an open frame surrounding the bottom portion of the shell, the upper edge of said frame being proportioned to engage the junction strip interconnecting the upper and bottom portions of the shell, casket handling rods mounted on and positioned laterally outside of said rectangular frame, and joints interconnecting the handling rods and the frame surrounding the bottom portions of the shell, said joints being located at points spaced along the outer side of the frame, the shell and said rectangular frame being separable by relative downward displacement of the frame with respect to the shell.

2. A casket as defined in claim 1 in which the bottom portion of the shell is configured to provide a downwardly open channel adjacent to the lower edge of the frame, and means in said channel for interconnecting the frame and the bottom portion of the shell, said means being connected with the inner side of said frame and with the outer side of the shell and being disengageable and thereby provide for said downward displacement of the frame with respect to the shell.

3. A casket as defined in claim 2 in which the means for interconnecting the frame and the bottom portion of the shell comprises an interconnecting element of U-shaped cross section with its base extending upwardly into said downwardly open channel adjacent the lower edge of the frame and with its sides extending downwardly, the means connecting said element with the frame being disconnectable to provide for separation of the frame independently of the U-shaped element and the shell.

4. A casket comprising a generally rectangular shell formed of sheet material, the shell having an upper portion with an upwardly presented opening, the shell also having a downwardly closed bottom portion of reduced dimensions both lengthwise and from side-to-side as compared with the upper portion, the closed bottom portion being upwardly flared at least in the bottom region thereof, a rectangular frame formed of wood and having interconnected side and end portions forming an open frame having inner and outer sides and adapted to be assembled with the inner side presented toward and in surrounding relation to the bottom portion of the shell, casket handling components mounted on the outer side of said rectangular frame, the shell and the frame having interengageable load-transmitting abutments providing for manually carrying the casket by manually engaging said handling components, the lower portion of the frame having a vertically extended wall portion surrounding the flared bottom portion of the shell and providing a downwardly open U-shaped channel between the frame and bottom portion of the shell, and means for retaining the frame and shell in assembled relation, said retaining means comprising U-shaped fastening devices positioned in said U-shaped channel and attachment means in said U-shaped channel and being disengageable to provide for separation of the frame and shell.

5. A casket as defined in claim 4 in which the means for retaining the frame and shell in assembled relation includes a fastening element secured to the outside surface of the shell and means disengageably connecting said element to the frame.

6. A casket comprising a generally rectangular shell formed of sheet metal, the shell having an upper portion with an upwardly presented opening, and having a downwardly closed lower or bottom portion having side walls of reduced dimensions both lengthwise and from side-to-side as compared with the upper portion, the side walls of each of the upper and lower portions of the shell being progressively upwardly flared throughout the height thereof, the side walls of the upper and lower portions of the shell being interconnected by a generally horizontal junction strip extended along both the sides and the ends of the shell, a rectangular frame formed of wood and having interconnected side and end portions forming an open frame surrounding the bottom portion of the shell, the upper edge of said frame being proportioned to engage the junction strip interconnecting the upper and bottom portions of the shell, casket handling components mounted on and positioned laterally outside of said rectangular frame, the shell and said rectangular frame being separable by relative displacement of the frame with respect to the shell, and disconnectable means for retaining the shell and frame in assembled relation, said means for retaining the shell and the frame in assembled relation being positioned between the inside of the frame and the outside of the flared side wall of the lower portion of the shell.

7. A casket comprising a generally rectangular shell formed of deep drawn sheet metal, the shell having an upper portion upwardly flared and with an upwardly presented opening, the shell also having a downwardly closed bottom portion of reduced dimension at least from side-to-side as compared with the upper portion, the upper and bottom portions of the shell being interconnected by a generally horizontal junction strip extended along at least the sides of the shell, a rectangular frame formed of wood and having interconnected side and end portions forming an open frame surrounding the bottom portion of the shell, the upper edge of at least the side portions of said frame being proportioned to engage the junction strip interconnecting the upper and bottom portions of the shell, casket handling rods mounted on and positioned laterally outside of the side portions of said rectangular frame, and joints interconnecting the handling rods and the frame, said joints being located at points spaced along the side portions of the frame, the shell and said rectangular frame being separable by relative downward displacement of the frame with respect to the shell.

8. A casket comprising a generally rectangular shell formed of sheet metal, the shell having an upper portion with an upwardly presented opening, the shell also having a downwardly closed bottom portion of reduced dimensions at least lengthwise of the casket as compared with the upper portion, the upper and bottom portions of the shell being interconnected by a generally horizontal junction strip extended along at least the sides of the shell, a rectangular frame formed of wood and having interconnected side and end portions forming an open frame surrounding the bottom portion of the shell, the upper edge of at least the side portions of said frame being proportioned to engage the junction strip interconnecting the upper and bottom portions of the shell, casket handling rods mounted on and positioned laterally outside of said rectangular frame, and joints interconnecting the handling rods and the frame, said joints being located at points spaced along the outer side of the frame, the shell and said rectangular frame being assemblable by relative upward movement of the frame with respect to the shell.

* * * * *